US007798492B2

(12) United States Patent
Horiuchi

(10) Patent No.: US 7,798,492 B2
(45) Date of Patent: Sep. 21, 2010

(54) SHEET CONVEYING APPARATUS

(75) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/435,129

(22) Filed: May 4, 2009

(65) Prior Publication Data

US 2009/0295064 A1 Dec. 3, 2009

Related U.S. Application Data

(63) Continuation of application No. PCT/JP2007/001180, filed on Oct. 29, 2007.

(30) Foreign Application Priority Data

Nov. 2, 2006 (JP) ..... 2006-299543

(51) Int. Cl.
*B65H 5/00* (2006.01)

(52) U.S. Cl. ..... 271/264; 271/272; 271/198; 198/806; 198/807

(58) Field of Classification Search ..... 271/264, 271/272, 275, 198; 198/806, 807
See application file for complete search history.

(56) References Cited

U.S. PATENT DOCUMENTS 3,973,446 A * 8/1976 Vasilantone ..... 474/107
4,174,171 A * 11/1979 Hamaker et al. ..... 399/165
4,286,706 A * 9/1981 Castelli et al. ..... 198/806
5,044,873 A * 9/1991 Vijuk ..... 414/792.5
5,342,038 A * 8/1994 Suter ..... 271/198
6,443,448 B1 * 9/2002 Mohr et al. ..... 271/270
7,058,345 B2 * 6/2006 Abe et al. ..... 399/303
7,434,680 B2 * 10/2008 Kitamura ..... 198/806

FOREIGN PATENT DOCUMENTS

JP 05-008889 1/1993
JP 10-194509 7/1998
JP 2006-001670 1/2006

* cited by examiner

*Primary Examiner*—David H Bollinger
(74) *Attorney, Agent, or Firm*—Pillsbury Winthrop Shaw Pittman, LLP

(57) ABSTRACT

To provide a sheet conveying apparatus capable of preventing meandering of a belt. A flange roller arranged at an entrance of sheets is used for a conveying roller immediately before a flange roller for feeding conveying rollers to a first conveying path for conveying the sheets. Namely, the flange roller is arranged just closely to an upstream side of the conveying belts arranged on the flange roller in a rotational direction. Further, a flange roller arranged at an exit of the sheets is used for a conveying roller immediately after a flange roller for feeding the conveying rollers finishing conveyance of the sheets on a second conveying path for discharging the sheets. Namely, the flange roller is arranged just closely to a downstream side of the conveying belts arranged on the flange roller in the rotational direction.

2 Claims, 6 Drawing Sheets

SHEET CONVEYING APPARATUS

CROSS-REFERENCE TO RELATED APPLICATION

This application is based upon and claims the benefit of priority from the prior Japanese Patent Application No. 2006-299543, filed on Nov. 2, 2006, and International Application No. PCT/JP2007/001180, filed on Oct. 29, 2007; the entire contents of all of which are incorporated herein by references.

FIELD OF THE INVENTION

The present invention relates to a sheet conveying apparatus for conveying sheets such as marketable securities using a conveying belt and more particularly to a sheet conveying apparatus capable of preventing meandering of the conveying belt.

DESCRIPTION OF THE BACKGROUND

A sheet conveying apparatus used in a sheet processing apparatus for processing sheets such as marketable securities is an apparatus for taking out and conveying the sheets one by one, performing authenticity discrimination or quality bill and disqualified bill discrimination of the sheets regarding a predetermined check area set on each sheet surface, and sorting them on the discrimination results. Therefore, the sheet processing apparatus, to stably ensure the check area and perform the sorting process such as the stacking process based on the check results, a meandering countermeasure for performing normal conveyance is important.

Conventionally, as such a meandering countermeasure, for example, in the case of conveyance using a flat belt, (1) installation of a crowning roller (a crown-shaped roller) (for example, refer to Patent Document 1) and (2) installation of a flange roller are known. Patent Document 1: Japanese Patent Application 2006-1670 (FIGS. 3 and 4 on pages 5 and 6)

However, in the sheet processing apparatus stated in Patent Document 1, when the material of the flat belt is hard, in the countermeasure of installation of the crowning roller, the belt does not get to fit the roller and the effect is low. Further, when the flange roller is installed for the conventional belt at the sheet conveying position, only a flange roller having a flange height in correspondence to the belt thickness can be installed and a problem arises that the belt runs over the flange.

The present invention was developed to solve the aforementioned problem and is intended to provide a sheet conveying apparatus capable of prevent meandering of the belt by using a flange roller with a flange height higher than the thickness of the belt in the folding-back portion of the conveying roller in the neighborhood of the discontinuous portions of belt conveyance such as the entrance portion of sheets and the exit portion of sheets.

SUMMARY OF THE INVENTION

To accomplish the above object, there is provided a sheet conveying apparatus structured so as to arrange a conveying roller along a conveying path to convey sheets and suspend a conveying belt over the conveying roller, comprising: a top conveying roller with a top conveying belt in contact with one surface of the sheets suspended over; a bottom conveying roller with a bottom conveying belt in contact with another surface of the sheets suspended over; a drive roller to drive the top and bottom conveying belts; a take-in portion for holding and taking in the sheets by permitting the top conveying belt and the bottom conveying belt to make contact with each other; a first flange roller arranged at a leading edge of the take-in portion for composing the top conveying roller; and a second flange roller arranged just closely to an upstream side of the top conveying belt suspended over the first flange roller in a rotational direction, wherein a flange height of the second flange roller is higher than a thickness of the top conveying belt.

Further, there is provided A sheet conveying apparatus structured so as to arrange a conveying roller along a conveying path to convey sheets and suspend a conveying belt over the conveying roller, comprising: a top conveying roller with a top conveying belt in contact with one surface of the sheets suspended over; a bottom conveying roller with a bottom conveying belt in contact with another surface of the sheets suspended over; a drive roller to drive the top and bottom conveying belts; a take-in portion to hold and take in the sheets by permitting the top conveying belt and the bottom conveying belt to make contact with each other; a feeding portion to feed the sheets taken-in by the take-in portion; a first flange roller arranged at a leading edge of the take-in portion to compose the top conveying roller; and a second flange roller arranged just closely to an upstream side of the top conveying belt suspended over the first flange roller in a rotational direction, wherein a flange height of the second flange roller is higher than a thickness of the bottom conveying belt.

DESCRIPTION OF THE PREFERRED EMBODIMENTS

Hereinafter, the embodiment of the present invention will be explained with reference to the accompanying drawings.

Figure 1:
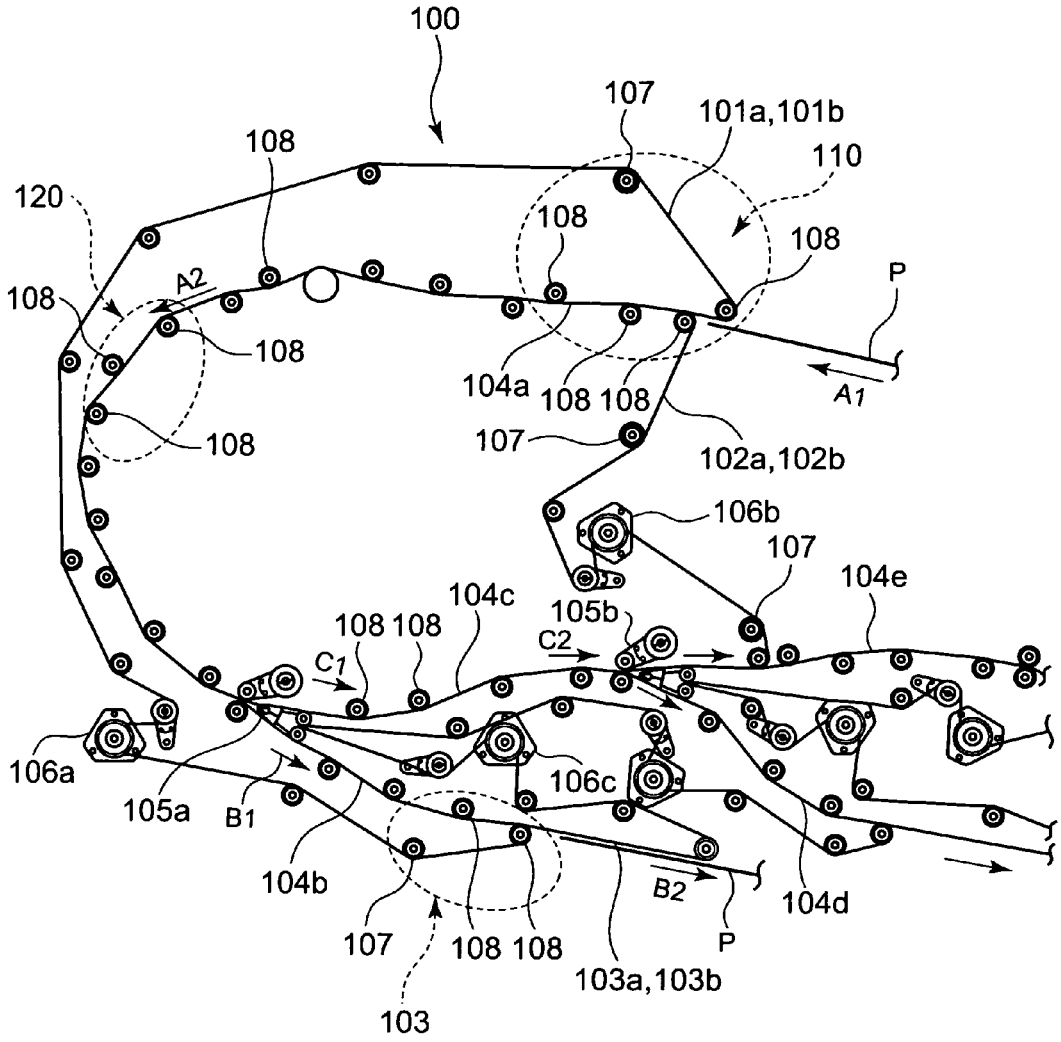
FIG. 1 is a schematic view of the sheet conveying apparatus used in the sheet processing apparatus of the embodiment of the present invention.

FIG. 1 is a schematic view of a sheet conveying apparatus 100 of the sheet processing apparatus (not shown) of the embodiment of the present invention. The sheet conveying apparatus 100 is an apparatus for conveying sheets P taken in from a sheet entrance portion 110 and conveys them by a first conveying path 104*a* composed of a conveying roller and a conveying belt. The sheets P conveyed by the first conveying path 104*a* are discriminated by a sheet discrimination apparatus (not shown) and are conveyed by a second conveying path 104*b*, a third conveying path 104*c*, or a fourth conveying path 104*d*.

On the first conveying path 104*a*, the top conveying roller arranged so as to suspend the top conveying belt in contact with the top (one surface) of each sheet along the conveying path and the bottom conveying roller arranged so as to suspend the bottom conveying belt in contact with the bottom (the other surface) of the sheet are born by the main body.

Two flat belts are arranged on the innermost side and on the operation side in the axial direction of the conveying roller and on the portion where flat belts 101*a* and 101*b* as a top conveying belt and flat belts 102*a* and 102*b* as a bottom conveying belt in contact with the bottom make contact with each other, the concerned sheets P are held and conveyed.

The flat belts 101*a* and 101*b* and the flat belts 102*a* and 102*b* are respectively composed of one continuous belt, and the flat belts 101*a* and 101*b* are driven by a drive roller 106*a*, and the flat belts 102*a* and 102*b* are driven by a drive roller 106*b*.

For the second conveying path 104*b*, the top conveying roller used for the first conveying path 104*a* is extended and used as it is and the bottom conveying roller arranged so as to suspend the bottom conveying belt in contact with the bottom of each sheet is born by the main body.

Two flat belts are arranged on the innermost side and on the operation side in the axial direction of the conveying roller and on the portion where the flat belts 101*a* and 101*b* as a top conveying belt and flat belts 103*a* and 103*b* as a bottom conveying belt in contact with the bottom make contact with each other, the concerned sheets P are held and conveyed.

The flat belts 101*a* and 101*b* and the flat belts 103*a* and 103*b* are respectively composed of one continuous belt, and the flat belts 101*a* and 101*b* are driven by the drive roller 106*a*, and the flat belts 103*a* and 103*b* are driven by a drive roller 106*c*.

The sheets P conveyed by the first conveying path 104*a* are switched by a branching gate 105*a* and when instructed so as to be conveyed in the direction of an arrow B1 shown in the drawing, the sheets P are furthermore conveyed by the second conveying path 104*b* and are fed in the direction of an arrow B2.

The same may be said with the third conveying path 104*c*, fourth conveying path 104*d*, and fifth conveying path 104*e*, so that the explanation thereof will be omitted here.

Figure 2:
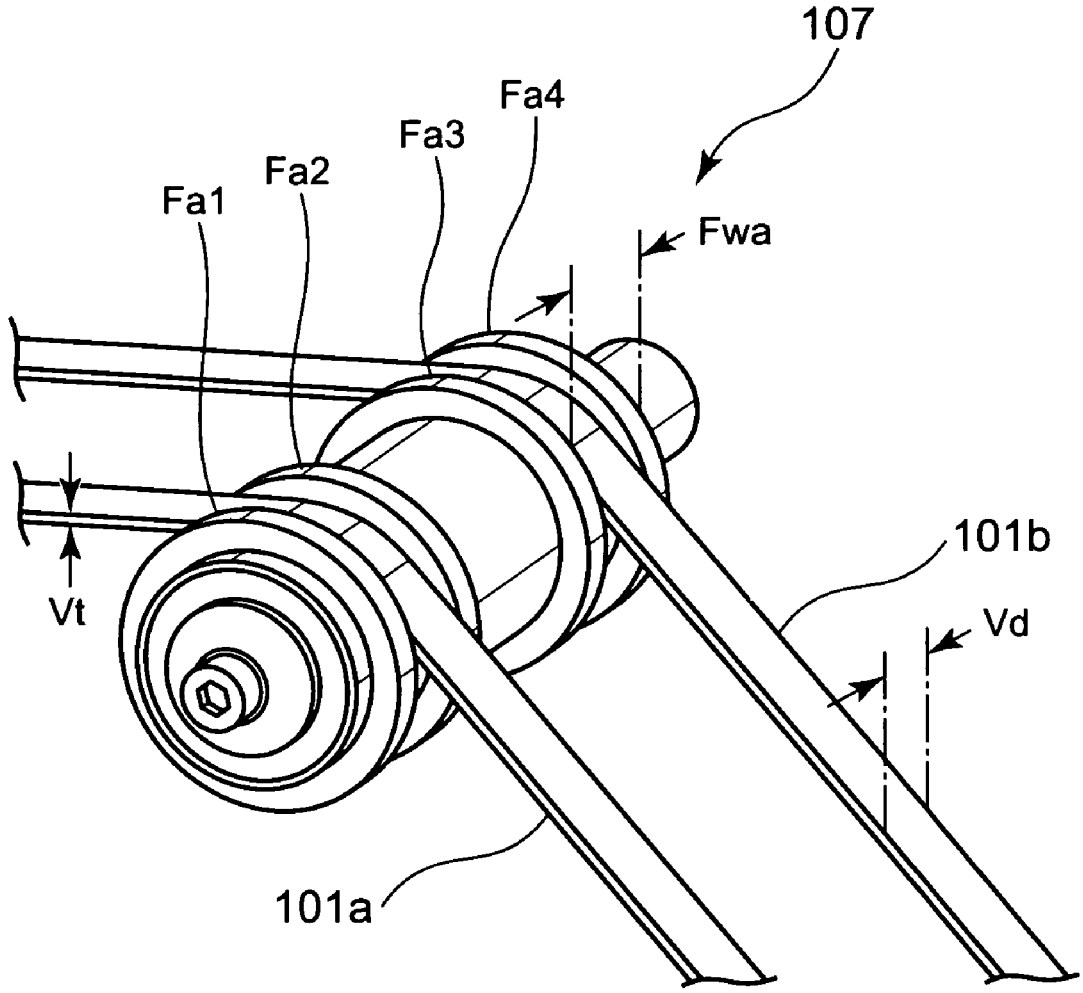
FIG. 2 is a perspective view showing the constitution of the flange roller shown in FIG. 1.

FIG. 2 is a perspective view showing the constitution of a flange roller (second flange roller) 107 shown in FIG. 1. The flange roller 107 has flanges Fa1 to Fa4 for preventing meandering of the flat belts in the axial direction. Hereinafter, the first conveying path 104*a* will be explained as an example. Between the flanges Fa1 and Fa2, the flat belt 101*a* is arranged and between the flanges Fa3 and Fa4, the flat belt 101*b* is arranged. A flange height Fha of the flanges Fa1 to Fa4 and a flange interval Fwa between the flanges Fa1 and Fa2 or between the flanges Fa3 and Fa4, assuming the width of the flat belts arranged between the flanges as Vd and the thickness thereof as Vt, are structured so as to meet the conditions of the formulas (1) and (2) indicated below.

$$Fha \geqq 3Vt + \Delta h \quad (1)$$

Fha: Height of flange

Vt: Thickness of flat belt

Δh: Allowable value of flange height $$Fwa = Vd + \Delta w \quad (2)$$

Fwa: Interval of flanges

Vd: Width of flat belt

Δw: Allowable value of flange interval

Namely, the flange height Fha of the flange roller (second flange roller) 107 is at least 3 times of the thickness Vt of the top conveying belt.

Further, in this embodiment, when Fha=3 Vt and Δw=0.5 mm are assumed, good results are obtained, though the present invention is not limited to it, and according to the form of the conveying path to be applied, an appropriate value is set.

Further, the material of the flat belts which is used in this embodiment has a structure that a polyamide film is used as a core and polyamide woven cloth and nitrile rubber are laminated.

The flange roller 107 aforementioned is used for the conveying roller immediately before the conveying roller 108 for supplying the conveying belts 101*a* and 101*b* to the conveying path 104*a* for conveying the sheets P. Namely, the flange roller (second flange roller) 107 is arranged just closely to the upstream side of the conveying belts 101*a* and 101*b* which are the top conveying belts suspended over the flange roller (first flange roller) 108 in the rotational direction.

By use of this arrangement, the meandering of the flat belt on the conveying surface for conveying sheets can be prevented. Further, on the conveying surface using the flange roller type, the flange height Fha is higher than the thickness of the flat belt, so that the sheets P are not conveyed.

Figure 3:
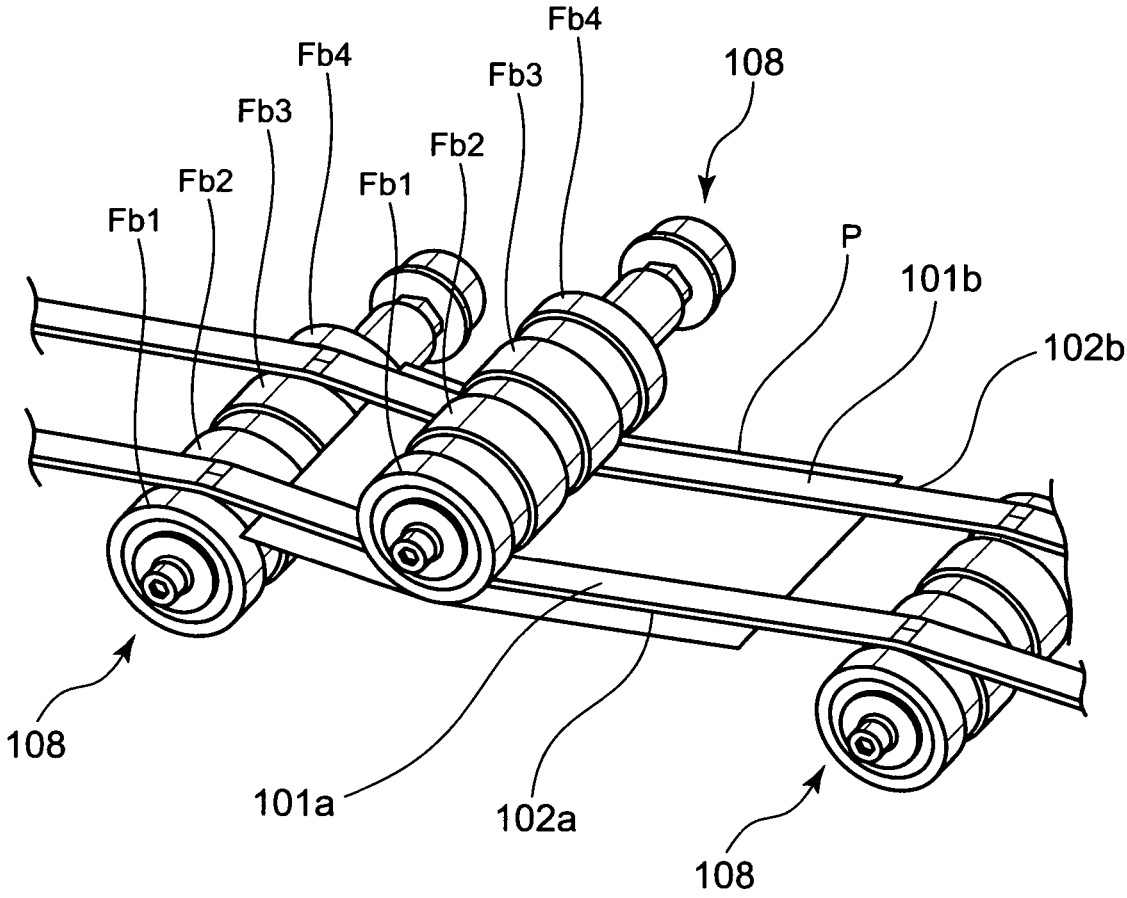
FIG. 3 is a perspective view showing the constitution of the flange roller shown in FIG. 1.

FIG. 3 is a perspective view showing the constitution of the flange roller 108 shown in FIG. 1. The flange roller 108 has flanges Fb1 to Fb4 for preventing the flat belt from meandering in the axial direction. Between the flanges Fb1 and Fb2, the flat belts 101*a* and 102*a* are arranged and between the flanges Fb3 and Fb4, the flat belts 101*b* and 102*b* are arranged. A flange height Fhb of the flanges Fb1 to Fb4 and a flange interval Fwb between the flanges Fb1 and Fb2, assuming the width of the flat belts arranged between the flanges as Vd and the thickness thereof as Vt, are structured so as to meet the conditions of the formulas (1) and (2) indicated below.

$$Fhb = Vt - \Delta h \quad (3)$$

Fhb: Height of flange

Vt: Thickness of flat belt

Δh: Allowable value of flange height $$Fwb = Vd + \Delta W \quad (4)$$

Vd: Width of flat belt

Fwb: Interval of flanges

Δw: Allowable value of flange interval

Namely, the flange height Fhb of the flange roller (first flange roller) 108 is set so as to be equal to the thickness Vt of the bottom conveying belt. Namely, it is set so as not to exceed the thickness Vt of the bottom conveying belt.

Figure 4:
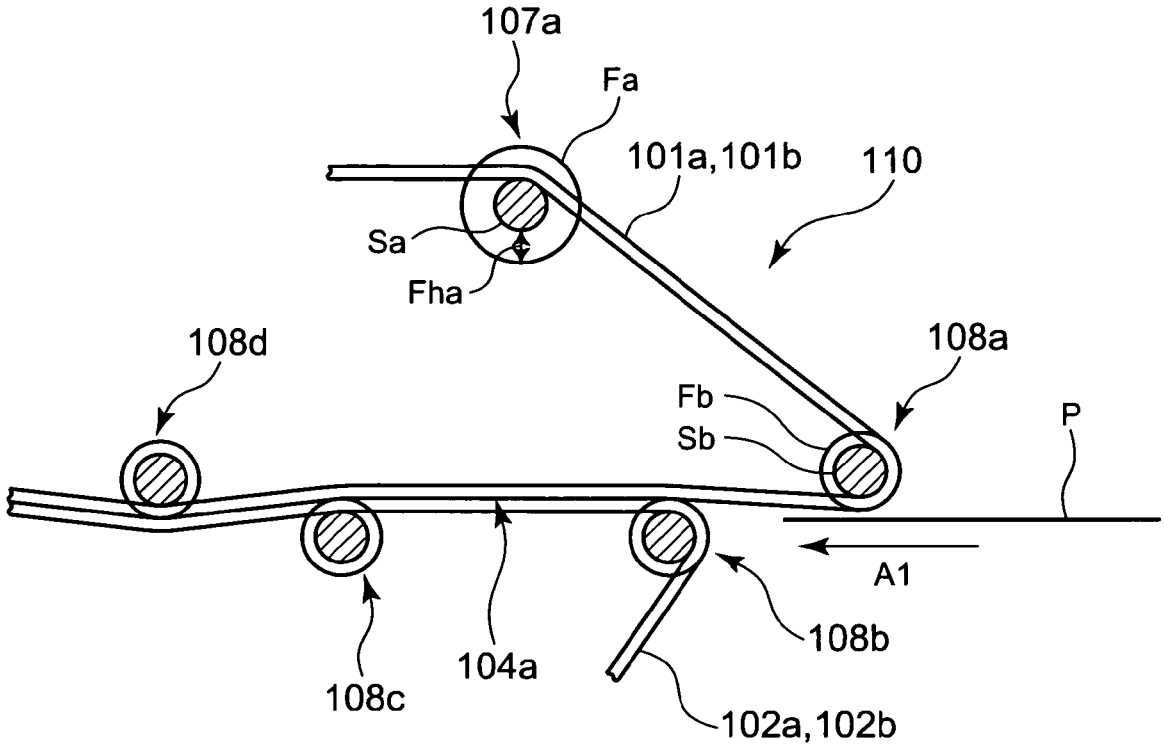
FIG. 4 is a detailed drawing of the sheet entrance portion of the first conveying path shown in FIG. 1.

FIG. 4 is a detailed drawing of the sheet entrance portion (take-in portion) 110 of the first conveying path 104*a* shown in FIG. 1. Here, the portion with which the flange roller 107*a* born on the top side for the conveying surface, the flat belts 101*a* and 101*b* suspended over the flange rollers 108*a* and 108*d*, and the flat belts 102*a* and 102*b* suspended over the flange roller 108*a* and 108*c* which are born on the bottom side for the conveying surface make contact is the first conveying path 104*a* aforementioned.

The first conveying path 104*a* drawn is structured so that the flat belts 101*a* and 101*b* suspended over the flange roller 107 and flange rollers 108*a* and 108*d* make contact with the top of each of the sheets P. The flat belts 102*a* and 102*b* suspended over the flange rollers 108*b*, 108*c*, and 108*d* are arranged so as to make contact with the bottom surface of each of the sheets P.

On the first conveying path 104*a* structured like this, the sheets P are held by the conveying belt arranged on the top side and the conveying belt arranged on the bottom side and are conveyed in the direction of an arrow A1 shown in the drawing.

Here, the flange roller 108*a* is born at the entrance of the sheets P and on the upstream side of the conveying belts 101*a* and 101*b* supplied to the flange roller 108*a* in the conveying rotational direction, the flange roller 107 is arranged. By use of this arrangement, the position of the conveying belt immediately before contact with the sheets P is specified, thus the meandering of the conveying belts 101*a* and 101*b* on the conveying path 104*a* can be prevented.

Figure 5:
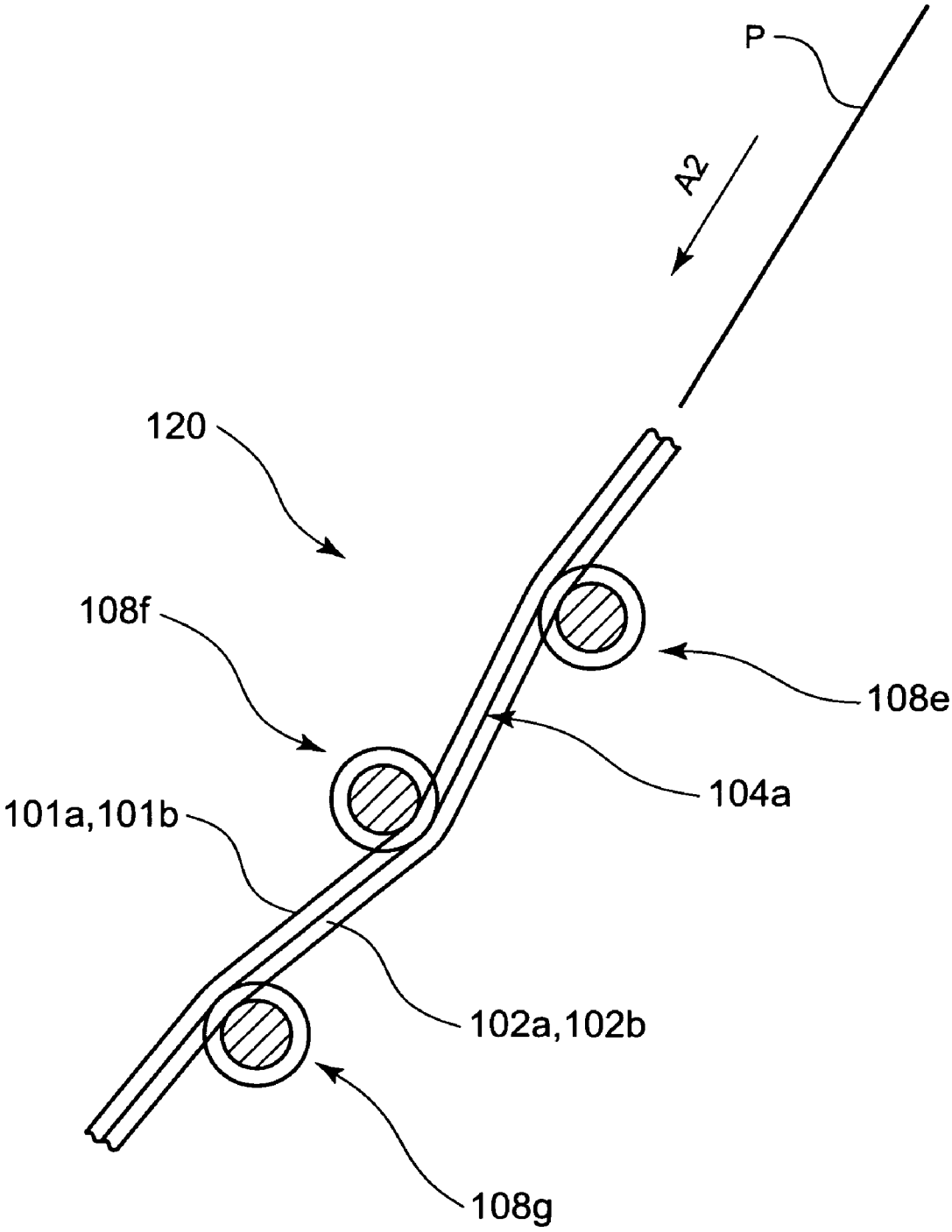
FIG. 5 is a detailed drawing of the central portion of the first conveying path shown in FIG. 1.

FIG. 5 is a detailed drawing of a central portion 120 of the first conveying path 104*a* shown in FIG. 1. Here, the flat belts 101*a* and 101*b* arranged on the top side for the conveying surface and the flat belts 102*a* and 102*b* arranged on the bottom side for the conveying surface hold and convey the sheets P.

Here, for all the conveying rollers, the flange roller 108 is used. Namely, the flange height of the flange rollers is formed so as to be almost equal to the thickness of the flat belts, so that the flange surface and conveying belt surface are almost in the uniform state and the flange surface is changed to the conveying surface, thus it makes contact with the sheets P and can prevent the meandering of the sheets P.

Figure 6:
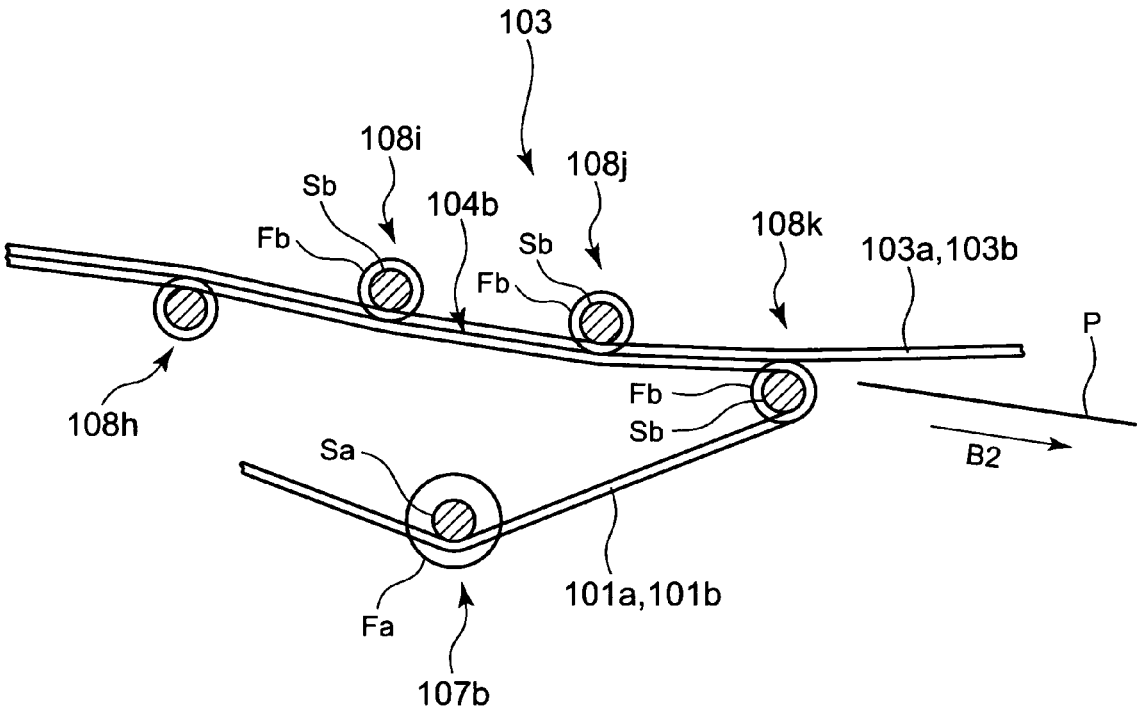
FIG. 6 is a detailed drawing of the sheet exit portion of the second conveying path shown in FIG. 1.

FIG. 6 is a detailed drawing of a sheet exit portion (feeding portion) 130 of the second conveying path 104*b* shown in FIG. 1. Here, the flat belts 101*a* and 101*b* suspended over flange rollers 108*h* and 108*k* and flange roller 107*b* which are born on the top side for the conveying surface and the flat belts 103*a* and 103*b* suspended over flange rollers 108*i* and 108*j* which are born on the bottom side hold and convey the sheets P in the direction of an arrow B2 shown in the drawing.

By use of this arrangement, the position of the conveying belt immediately after conveyance of the sheets P can be controlled, thus the conveying belts 101*a* and 101*b* on the conveying path 104*b* can be prevented from meandering.

As explained above, according to the embodiments of the present invention, in the folding-back portion of the discontinuous portion of belt conveyance such as the entrance portion of sheets and exit portion of sheets, the flange roller with a flange height higher than the belt thickness is used, thus the belt can be prevented from meandering.

What is claimed is:

1. A sheet conveying apparatus structured so as to arrange a conveying roller along a conveying path to convey sheets and suspend a conveying belt over the conveying roller, comprising:

a top conveying roller with a top conveying belt in contact with one surface of the sheets suspended over;

a bottom conveying roller with a bottom conveying belt in contact with another surface of the sheets suspended over;

a drive roller to drive the top and bottom conveying belts;

a take-in portion for holding and taking in the sheets by permitting the top conveying belt and the bottom conveying belt to make contact with each other;

a first flange roller arranged at a leading edge of the take-in portion for composing the top conveying roller; and a second flange roller arranged just closely to an upstream side of the top conveying belt suspended over the first flange roller in a rotational direction, wherein a flange height of the first flange roller with the top conveying belt suspended over does not exceed the thickness of the top conveying belt, and the flange height of the second flange roller with the top conveying belt suspended over is at least 3 times of the thickness of the top conveying belt.

2. A sheet conveying apparatus structured so as to arrange a conveying roller along a conveying path to convey sheets and suspend a conveying belt over the conveying roller, comprising:

a top conveying roller with a top conveying belt in contact with one surface of the sheets suspended over;

a bottom conveying roller with a bottom conveying belt in contact with another surface of the sheets suspended over;

a drive roller to drive the top and bottom conveying belts;

a take-in portion to hold and take in the sheets by permitting the top conveying belt and the bottom conveying belt to make contact with each other;

a feeding portion to feed the sheets taken-in by the take-in portion;

a first flange roller arranged at a leading edge of the take-in portion to compose the top conveying roller; and a second flange roller arranged just closely to an upstream side of the top conveying belt suspended over the first flange roller in a rotational direction, wherein a flange height of the first flange roller with the bottom conveying belt suspended over does not exceed the thickness of the bottom conveying belt, and the flange height of the second flange roller with the bottom conveying belt suspended over is at least 3 times of the thickness of the bottom conveying belt.

* * * * *